US009781799B2

(12) United States Patent
Harbers et al.

(10) Patent No.: US 9,781,799 B2
(45) Date of Patent: Oct. 3, 2017

(54) LED-BASED ILLUMINATION DEVICE REFLECTOR HAVING SENSE AND COMMUNICATION CAPABILITY

(71) Applicant: Xicato, Inc., San Jose, CA (US)

(72) Inventors: Gerard Harbers, Sunnyvale, CA (US); Barry Mark Loveridge, San Jose, CA (US); Peter K. Tseng, San Jose, CA (US); John S. Yriberri, Pittsburgh, PA (US)

( * ) Notice: Subject to any disclaimer, the term of this patent is extended or adjusted under 35 U.S.C. 154(b) by 240 days.

(21) Appl. No.: 14/703,638

(22) Filed: May 4, 2015

(65) Prior Publication Data

US 2015/0316230 A1 Nov. 5, 2015

Related U.S. Application Data

(60) Provisional application No. 61/988,668, filed on May 5, 2014.

(51) Int. Cl.
*H05B 33/08* (2006.01)
*F21V 7/10* (2006.01)
(Continued)

(52) U.S. Cl.
CPC ..... *H05B 33/0857* (2013.01); *F21V 7/10* (2013.01); *F21V 23/0442* (2013.01);
(Continued)

(58) Field of Classification Search
CPC ..... F21V 7/10; F21V 23/0442; F21V 29/70; F21Y 2115/10; H05B 33/0809;
(Continued)

(56) References Cited

U.S. PATENT DOCUMENTS 5,959,316 A 9/1999 Lowery
6,191,541 B1 2/2001 Patel et al.
(Continued)

OTHER PUBLICATIONS

International Search Report and Written Opinion mailed on Aug. 3, 2015 for International Application No. PCT/US2015/029320 filed on May 5, 2015 by Xicato, Inc., 8 pages.

*Primary Examiner* — Stephen F Husar
(74) *Attorney, Agent, or Firm* — Silicon Valley Patent Group LLP

(57) ABSTRACT

A reflector housing is detachably coupled to an LED based illumination device and includes a flange having a surface facing the environment illuminated by the LED based illumination device. The reflector housing further includes a reflector having an input port that receives light emitted from the LED based illumination device and an output port through which light passes toward the environment. At least one sensor, such as a sensor for occupancy, an ambient light, a temperature, ultrasound, vibration, pressure, or a camera, microphone, visual indicator, or photodetector, is coupled to the flange such that at least a portion of the sensor faces the environment illuminated by the LED based illumination device. A reflector interface module configured to receive at least one signal from the sensor is coupled to the reflector housing. Additionally, a communications interface subsystem is configured to transmit and receive communications signals to and from the reflector housing.

26 Claims, 10 Drawing Sheets

(51) Int. Cl.

| | |
|---|---|
| ***F21V 29/70*** | (2015.01) |
| ***F21V 23/04*** | (2006.01) |
| ***H05B 37/02*** | (2006.01) |
| *F21Y 115/10* | (2016.01) |

(52) U.S. Cl.
CPC ..... *F21V 29/70* (2015.01); *H05B 33/0809* (2013.01); *H05B 33/0872* (2013.01); *H05B 37/0263* (2013.01); *H05B 37/0272* (2013.01); *F21Y 2115/10* (2016.08)

(58) Field of Classification Search
CPC ..... H05B 33/0857; H05B 33/0872; H05B 37/0263; H05B 37/0272
See application file for complete search history.

(56) References Cited

U.S. PATENT DOCUMENTS

| | | | | |
|---|---|---|---|---|
| 6,351,069 | B1 | 2/2002 | Lowery et al. | |
| 6,504,301 | B1 | 1/2003 | Lowery | |
| 6,586,882 | B1 | 7/2003 | Harbers | |
| 6,600,175 | B1 | 7/2003 | Baretz et al. | |
| 6,680,569 | B2 | 1/2004 | Mueller-Mach et al. | |
| 6,812,500 | B2 | 11/2004 | Reeh et al. | |
| 7,126,162 | B2 | 10/2006 | Reeh et al. | |
| 7,250,715 | B2 | 7/2007 | Mueller et al. | |
| 7,479,662 | B2 | 1/2009 | Soules et al. | |
| 7,564,180 | B2 | 7/2009 | Brandes | |
| 7,614,759 | B2 | 11/2009 | Negley | |
| 7,629,621 | B2 | 12/2009 | Reeh et al. | |
| 8,237,381 | B2 * | 8/2012 | Harbers | H05B 33/0803 315/149 |
| 8,282,250 | B1 | 10/2012 | Dassanayake et al. | |
| 8,517,562 | B2 * | 8/2013 | Harbers | H05B 33/0803 362/223 |
| 8,519,714 | B2 * | 8/2013 | Harbers | H05B 33/0893 324/414 |
| 9,046,235 | B2 * | 6/2015 | Wilson | F21S 9/035 |
| 9,360,168 | B2 * | 6/2016 | Harbers | H05B 33/0803 |
| 2007/0081336 | A1 | 4/2007 | Bierhuizen et al. | |
| 2014/0070710 | A1 | 3/2014 | Harris | |

* cited by examiner

LED-BASED ILLUMINATION DEVICE REFLECTOR HAVING SENSE AND COMMUNICATION CAPABILITY

CROSS REFERENCE TO RELATED APPLICATIONS

This application claims priority under 35 USC 119 to U.S. Provisional Application No. 61/988,668, filed May 5, 2014, which is incorporated by reference herein in its entirety.

TECHNICAL FIELD

The described embodiments relate to illumination devices that include Light Emitting Diodes (LEDs).

BACKGROUND

The use of LEDs in general lighting is becoming more common and more prevalent. Illumination devices that combine a number of LEDs may be used to improve the color quality and rendering, but suffer from spatial and/or angular variations in the color. Moreover, illumination devices that use LEDs sometimes are limited in the resulting emission patterns. Reflectors are sometimes used with LED based illumination devices to produce a more pleasing emission pattern.

SUMMARY

A reflector housing is detachably coupled to an LED based illumination device and includes a flange having a surface facing the environment illuminated by the LED based illumination device. The reflector housing further includes a reflector having an input port that receives light emitted from the LED based illumination device and an output port through which light passes toward the environment. At least one sensor, such as a sensor for occupancy, ambient light, temperature, ultrasound, vibration, pressure, gyro-scope, magnetic field, gas detector, smoke detector, or a camera, microphone, visual indicator, or photodetector, is coupled to the flange such that at least a portion of the sensor faces the environment illuminated by the LED based illumination device. A reflector interface module configured to receive at least one signal from the sensor is coupled to the reflector housing. Additionally, a communications interface subsystem is configured to transmit and receive communications signals to and from the reflector housing.

In one implementation, an apparatus includes a reflector housing configured to be detachably coupled to an LED based illumination device that is configured to illuminate an environment. The reflector housing includes a flange having a surface facing the environment illuminated by the LED based illumination device; and a reflector having an input port configured to receive a first amount of light emitted from the LED based illumination device and an output port through which light passes toward the environment. The reflector is configured to redirect at least a portion of the first amount of light emitted from the LED based illumination device toward the output port. A sensor is coupled to the flange of the reflector housing such that at least a portion of the sensor faces the environment illuminated by the LED based illumination device. A reflector interface module coupled to the reflector housing is configured to receive at least one signal from the sensor. In addition, a first communications interface subsystem is configured to transmit and receive communications signals to and from the reflector housing.

BRIEF DESCRIPTION OF THE DRAWINGS

The accompanying drawings, where like numerals indicate like components, illustrate embodiments of the invention.

DETAILED DESCRIPTION

Reference will now be made in detail to background examples and some embodiments of the invention, examples of which are illustrated in the accompanying drawings.

Figure 1:
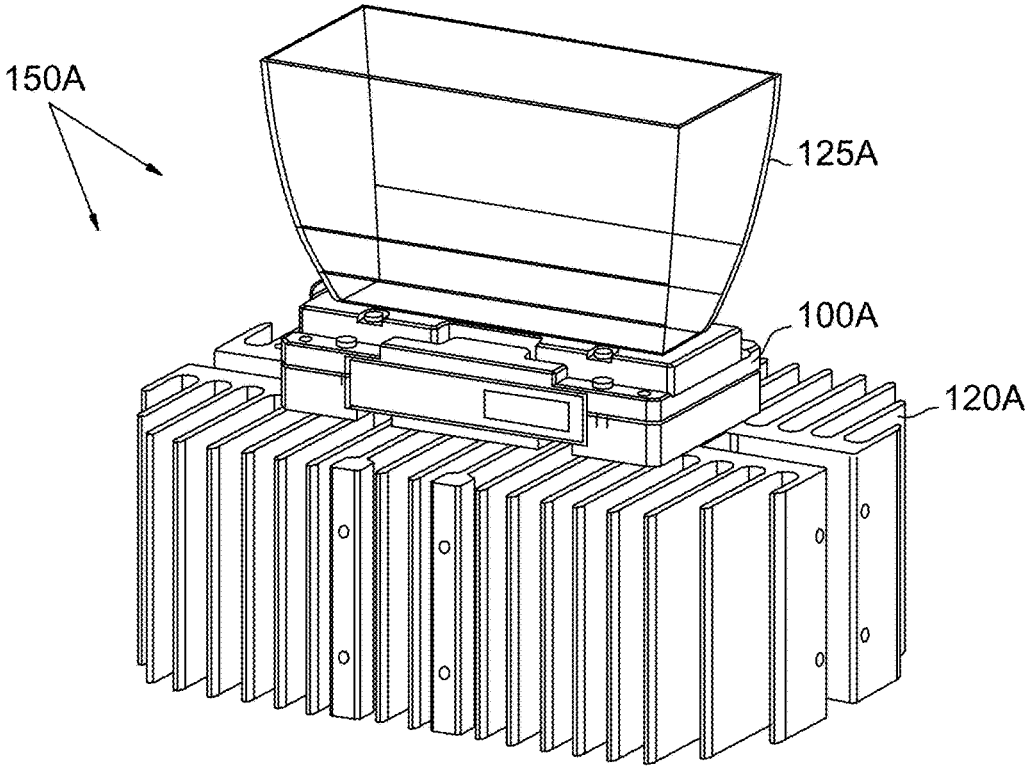
FIGS. 1, 2, and 3 illustrate exemplary luminaires, including an illumination device, reflector, and light fixture.
Figure 2:
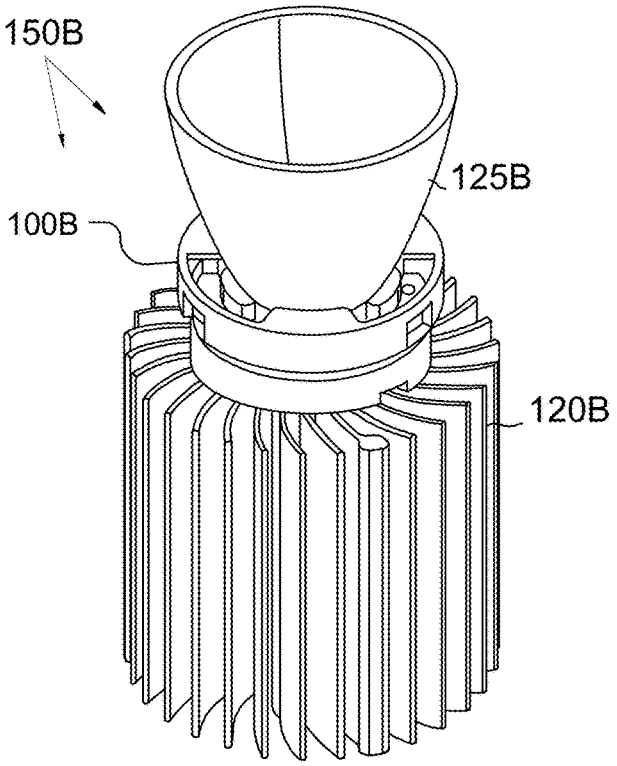
Figure 3:
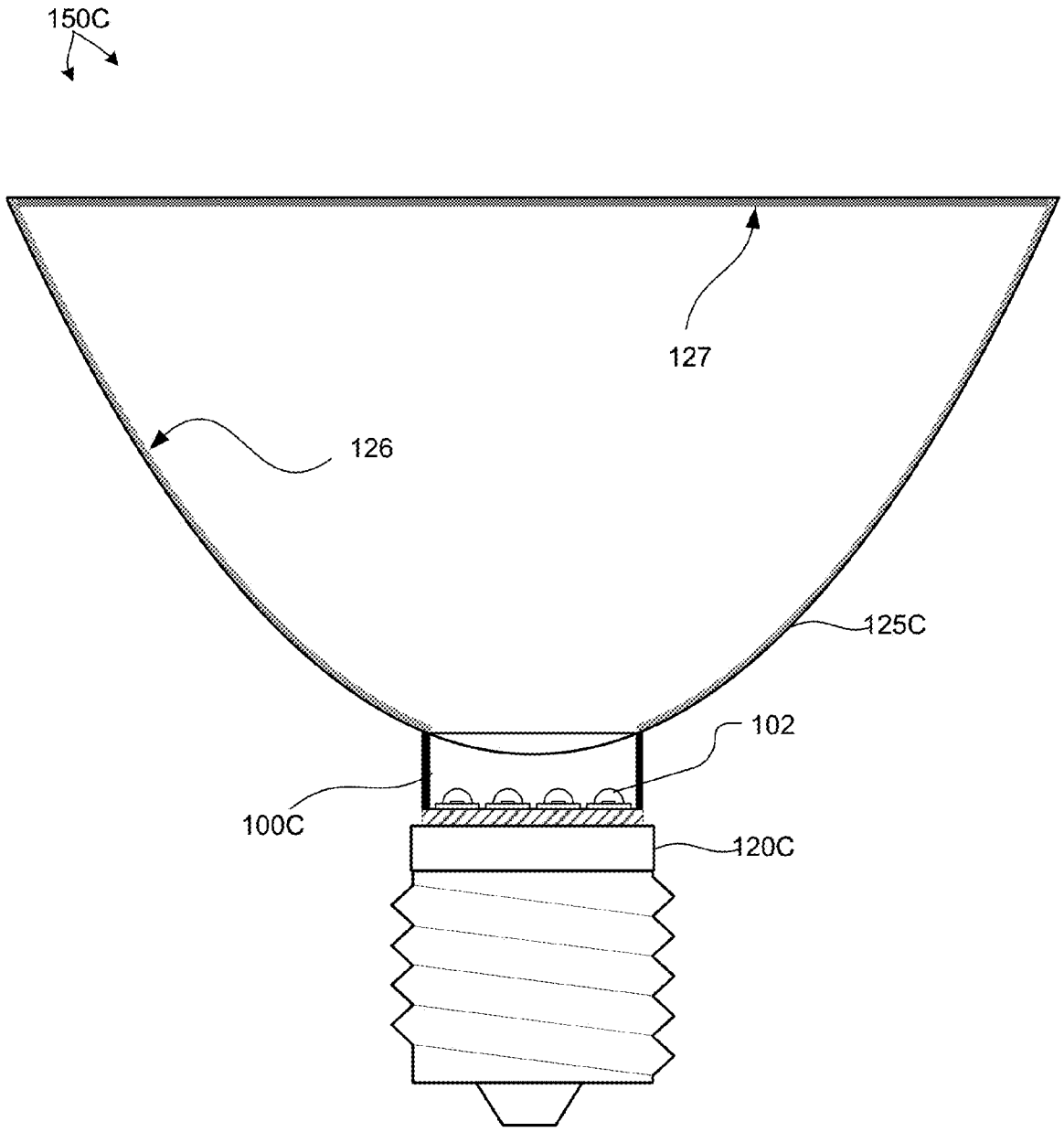

FIGS. 1, 2, and 3 illustrate three exemplary luminaires, respectively all labeled 150A, 150B, and 150C (sometimes collectively or generally referred to as luminaire 150). The luminaire 150A illustrated in FIG. 1 includes an illumination device 100A with a rectangular form factor. The luminaire 150B illustrated in FIG. 2 includes an illumination device 100B with a circular form factor. The luminaire 150C illustrated in FIG. 3 includes an illumination device 100C integrated into a retrofit lamp device. These examples are for illustrative purposes. Examples of illumination devices of general polygonal and elliptical shapes may also be contemplated. Luminaire 150 includes illumination device 100, reflector 125, and light fixture 120. FIG. 1 illustrates luminaire 150A with an LED based illumination device 100A, reflector 125A, and light fixture 120A. FIG. 2 illustrates luminaire 150B with an LED based illumination device 100B, reflector 125B, and light fixture 120B. FIG. 3 illustrates luminaire 150C with an LED based illumination device 100C, reflector 125C, and light fixture 120C. For the sake of simplicity, LED based illumination devices 100A, 100B, and 100C may be collectively referred to as illumination device 100, reflectors 125A, 125B, and 125C may be collectively referred to as reflector 125, and light fixtures 120A, 120B, and 120C may be collectively referred to as light fixture 120. As illustrated in FIG. 3, the LED based illumination device 100 includes LEDs 102. As depicted, light fixture 120 includes a heat sink capability, and therefore may be sometimes referred to as heat sink 120. However, light fixture 120 may include other structural and decorative elements (not shown). Reflector 125 is mounted to illumination device 100 to collimate or deflect light emitted from illumination device 100. The reflector 125 may be made from a thermally conductive material, such as a material that includes aluminum or copper and may be thermally coupled to illumination device 100. Heat flows by conduction through illumination device 100 and the thermally conductive reflector 125. Heat also flows via thermal convection over the reflector 125. Reflector 125 may be a compound parabolic concentrator, where the concentrator is constructed of or coated with a highly reflecting material. Optical elements, such as a diffuser or reflector 125 may be detachably coupled to illumination device 100, e.g., by means of threads, a clamp, a twist-lock mechanism, or other appropriate arrangement. As illustrated in FIG. 3, the reflector 125 may include sidewalls 126 and a window 127 that are optionally coated, e.g., with a wavelength converting material, diffusing material or any other desired material.

As depicted in FIGS. 1, 2, and 3, illumination device 100 is mounted to heat sink 120. Heat sink 120 may be made from a thermally conductive material, such as a material that includes aluminum or copper and may be thermally coupled to illumination device 100. Heat flows by conduction through illumination device 100 and the thermally conductive heat sink 120. Heat also flows via thermal convection over heat sink 120. Illumination device 100 may be attached to heat sink 120 by way of screw threads to clamp the illumination device 100 to the heat sink 120. To facilitate easy removal and replacement of illumination device 100, illumination device 100 may be detachably coupled to heat sink 120, e.g., by means of a clamp mechanism, a twist-lock mechanism, or other appropriate arrangement. Illumination device 100 includes at least one thermally conductive surface that is thermally coupled to heat sink 120, e.g., directly or using thermal grease, thermal tape, thermal pads, or thermal epoxy. For adequate cooling of the LEDs, a thermal contact area of at least 50 square millimeters, but preferably 100 square millimeters should be used per one watt of electrical energy flow into the LEDs on the board. For example, in the case when 20 LEDs are used, a 1000 to 2000 square millimeter heatsink contact area should be used. Using a larger heat sink 120 may permit the LEDs 102 to be driven at higher power, and also allows for different heat sink designs. For example, some designs may exhibit a cooling capacity that is less dependent on the orientation of the heat sink. In addition, fans or other solutions for forced cooling may be used to remove the heat from the device. The bottom heat sink may include an aperture so that electrical connections can be made to the illumination device 100.

Figure 4:
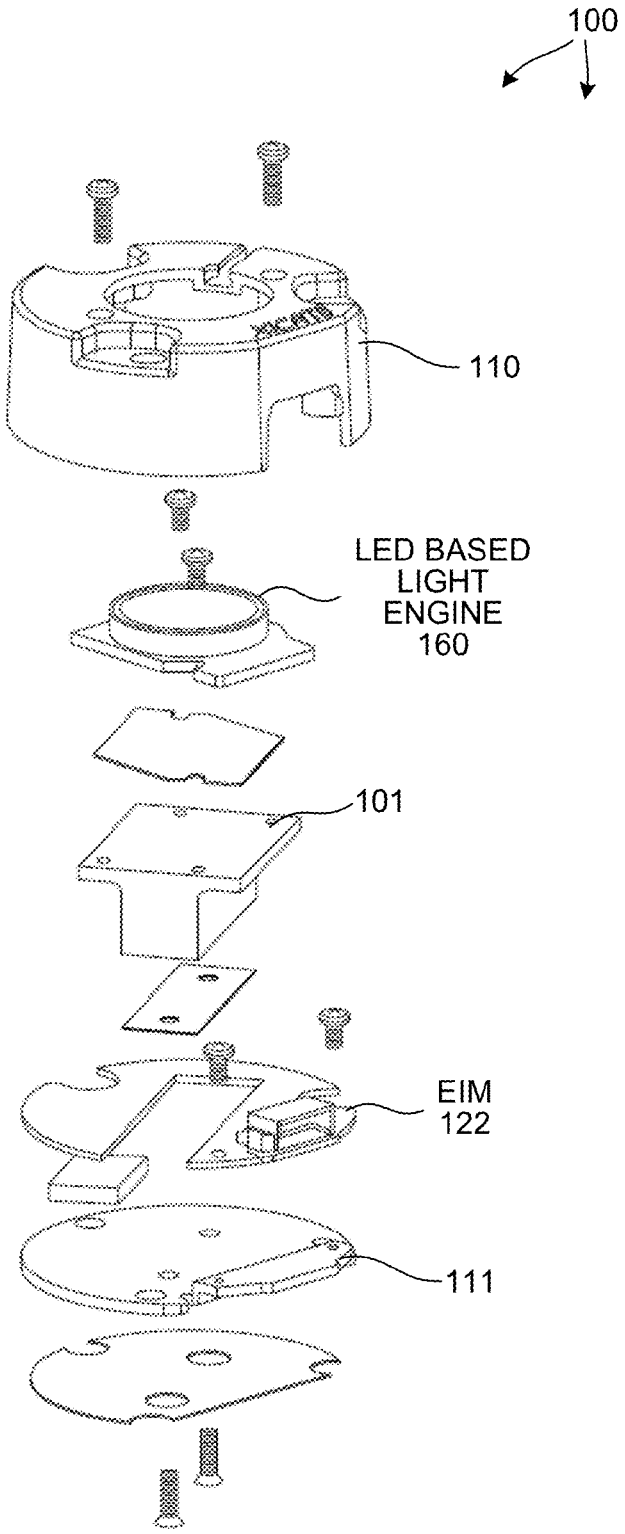
FIG. 4 shows an exploded view illustrating components of LED based illumination device as depicted in FIG. 2.

FIG. 4 shows an exploded view illustrating components of LED based illumination device 100 as depicted in FIG. 2. It should be understood that as defined herein an LED based illumination device is not an LED, but is an LED light source or fixture or component part of an LED light source or fixture. LED based illumination device 100 includes an LED based light engine 160 configured to generate an amount of light. LED based light engine 160 is coupled to a mounting base 101 to promote heat extraction from LED based light engine 160. Optionally, an electrical interface module (EIM) 122 is shaped to fit around mounting base 101. LED based light engine 160 and mounting base 101 are enclosed between a lower mounting plate 111 and an upper housing 110. An optional reflector retainer (not shown) is coupled to upper housing 110. The reflector retainer is configured to facilitate attachment of different reflectors to the LED based illumination device 100.

Figure 5:
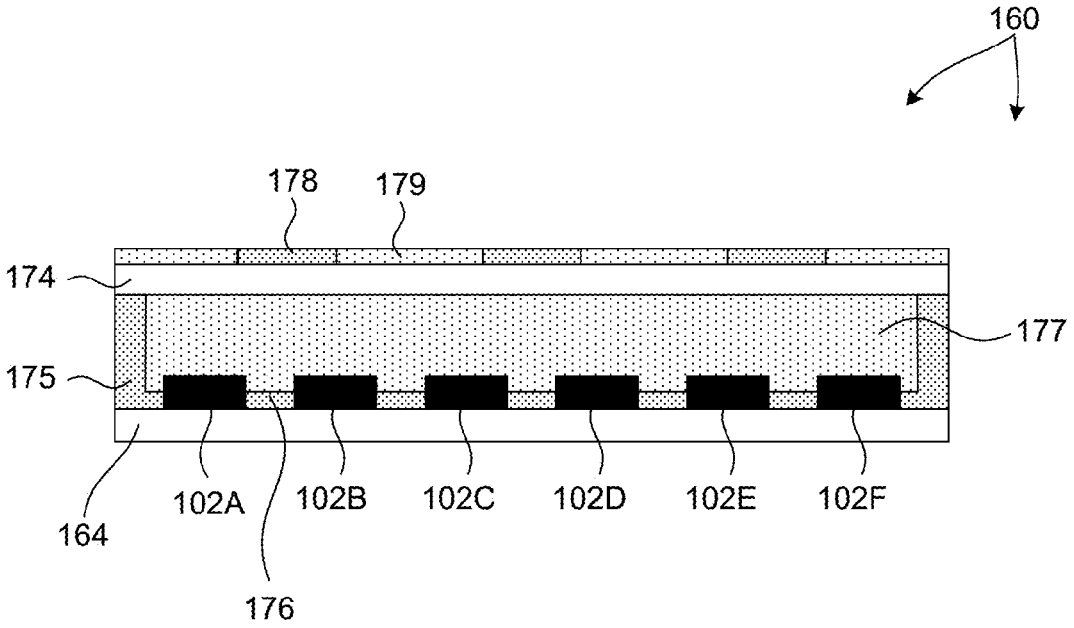
FIG. 5 is illustrative of an LED based light engine that may be used in the LED based illumination device.

FIG. 5 is illustrative of LED based light engine 160 in one embodiment. LED based light engine 160 includes one or more LED die or packaged LEDs and a mounting board to which LED die or packaged LEDs are attached. In addition, LED based light engine 160 includes one or more transmissive elements (e.g., windows or sidewalls) coated or impregnated with one or more wavelength converting materials to achieve light emission at a desired color point.

As illustrated in FIG. 5, LED based light engine 160 includes a number of LEDs 102A-F (collectively referred to as LEDs 102) mounted to mounting board 164 in a chip on board (COB) configuration. The spaces between each LED are filled with a reflective material 176 (e.g., a white silicone material). In addition, a dam of reflective material 175 surrounds the LEDs 102 and supports transmissive element 174, sometimes referred to as transmissive plate 174. The space between LEDs 102 and transmissive plate 174 is filled with an encapsulating material 177 (e.g., silicone) to promote light extraction from LEDs 102 and to separate LEDs 102 from the environment. In the depicted embodiment, the dam of reflective material 175 is both the thermally conductive structure that conducts heat from transmissive plate 174 to LED mounting board 164 and the optically reflective structure that reflects incident light from LEDs 102 toward transmissive plate 174.

LEDs 102 can emit different or the same color light, either by direct emission or by phosphor conversion, e.g., where phosphor layers are applied to the LEDs as part of the LED package. The illumination device 100 may use any combination of colored LEDs 102, such as red, green, blue, ultraviolet, amber, or cyan, or the LEDs 102 may all produce the same color light. Some or all of the LEDs 102 may produce white light. In addition, the LEDs 102 may emit polarized light or non-polarized light and LED based illumination device 100 may use any combination of polarized or non-polarized LEDs. In some embodiments, LEDs 102 emit either blue or UV light because of the efficiency of LEDs emitting in these wavelength ranges. The light emitted from the illumination device 100 has a desired color when LEDs 102 are used in combination with wavelength converting materials on transmissive plate 174, for example. By tuning the chemical and/or physical (such as thickness and concentration) properties of the wavelength converting materials and the geometric properties of the coatings on the surface of transmissive plate 174, specific color properties of light output by LED based illumination device 100 may be specified, e.g., color point, color temperature, and color rendering index (CRI).

For purposes of this patent document, a wavelength converting material is any single chemical compound or mixture of different chemical compounds that performs a color conversion function, e.g., absorbs an amount of light of one peak wavelength, and in response, emits an amount of light at another peak wavelength.

By way of example, phosphors may be chosen from the set denoted by the following chemical formulas: Y3Al5O12:Ce, (also known as YAG:Ce, or simply YAG) (Y,Gd)3Al5O12:Ce, CaS:Eu, SrS:Eu, SrGa2S4:Eu, Ca3(Sc,Mg)2Si3O12:Ce, Ca3Sc2Si3O12:Ce, Ca3Sc2O4:Ce, Ba3Si6O12N2:Eu, (Sr,Ca)AlSiN3:Eu, CaAlSiN3:Eu, CaAlSi(ON)3:Eu, Ba2SiO4:Eu, Sr2SiO4:Eu, Ca2SiO4:Eu, CaSc2O4:Ce, CaSi2O2N2:Eu, SrSi2O2N2:Eu, BaSi2O2N2:Eu, Ca5(PO4)3Cl:Eu, Ba5(PO4)3Cl:Eu, Cs2CaP2O7, Cs2SrP2O7, Lu3Al5O12:Ce, Ca8Mg(SiO4)4Cl2:Eu, Sr8Mg(SiO4)4Cl2:Eu, La3Si6N11:Ce, Y3Ga5O12:Ce, Gd3Ga5O12:Ce, Tb3Al5O12:Ce, Tb3Ga5O12:Ce, and Lu3Ga5O12:Ce.

In one example, the adjustment of color point of the illumination device may be accomplished by adding or removing wavelength converting material from transmissive plate 174. In one embodiment a red emitting phosphor 179 such as an alkaline earth oxy silicon nitride covers a portion of transmissive plate 174, and a yellow emitting phosphor 178 such as a YAG phosphor covers another portion of transmissive plate 174.

In some embodiments, the phosphors are mixed in a suitable solvent medium with a binder and, optionally, a surfactant and a plasticizer. The resulting mixture is deposited by any of spraying, screen printing, blade coating, jetting, or other suitable means. By choosing the shape and height of the transmissive plate 174, and selecting which portions of transmissive plate 174 will be covered with a particular phosphor or not, and by optimization of the layer thickness and concentration of a phosphor layer on the surfaces, the color point of the light emitted from the device can be tuned as desired.

In one example, a single type of wavelength converting material may be patterned on a portion of transmissive plate 174. By way of example, a red emitting phosphor 179 may be patterned on different areas of the transmissive plate 174 and a yellow emitting phosphor 178 may be patterned on other areas of transmissive plate 174. In some examples, the areas may be physically separated from one another. In some other examples, the areas may be adjacent to one another. The coverage and/or concentrations of the phosphors may be varied to produce different color temperatures. It should be understood that the coverage area of the red and/or the concentrations of the red and yellow phosphors will need to vary to produce the desired color temperatures if the light produced by the LEDs 102 varies. The color performance of the LEDs 102, red phosphor and the yellow phosphor may be measured and modified by any of adding or removing phosphor material based on performance so that the final assembled product produces the desired color temperature.

Transmissive plate 174 may be constructed from a suitable optically transmissive material (e.g., sapphire, quartz, alumina, crown glass, polycarbonate, and other plastics). Transmissive plate 174 is spaced above the light emitting surface of LEDs 102 by a clearance distance. In some embodiments, this is desirable to allow clearance for wire bond connections from the LED package submount to the active area of the LED. In some embodiments, a clearance of one millimeter or less is desirable to allow clearance for wire bond connections. In some other embodiments, a clearance of two hundred microns or less is desirable to enhance light extraction from the LEDs 102.

In some other embodiments, the clearance distance may be determined by the size of the LED 102. For example, the size of the LED 102 may be characterized by the length dimension of any side of a single, square shaped active die area. In some other examples, the size of the LED 102 may be characterized by the length dimension of any side of a rectangular shaped active die area. Some LEDs 102 include many active die areas (e.g., LED arrays). In these examples, the size of the LED 102 may be characterized by either the size of any individual die or by the size of the entire array. In some embodiments, the clearance should be less than the size of the LED 102. In some embodiments, the clearance should be less than twenty percent of the size of the LED 102. In some embodiments, the clearance should be less than five percent of the size of the LED. As the clearance is reduced, light extraction efficiency may be improved, but output beam uniformity may also degrade.

In some other embodiments, it is desirable to attach transmissive plate 174 directly to the surface of the LED 102. In this manner, the direct thermal contact between transmissive plate 174 and LEDs 102 promotes heat dissipation from LEDs 102. In some other embodiments, the space between mounting board 164 and transmissive plate 174 may be filled with a solid encapsulate material. By way of example, silicone may be used to fill the space. In some other embodiments, the space may be filled with a fluid to promote heat extraction from LEDs 102.

In the embodiment illustrated in FIG. 5, the surface of patterned transmissive plate 174 facing LEDs 102 is coupled to LEDs 102 by an amount of flexible, optically translucent encapsulating material 177. By way of non-limiting example, the flexible, optically translucent encapsulating material 177 may include an adhesive, an optically clear silicone, a silicone loaded with reflective particles (e.g., titanium dioxide ($TiO_2$), zinc oxide (ZnO), and barium sulfate ($BaSO_4$) particles, or a combination of these materials), a silicone loaded with a wavelength converting material (e.g., phosphor particles), a sintered PTFE material, etc. Such material may be applied to couple transmissive plate 174 to LEDs 102 in any of the embodiments described herein.

In some embodiments, multiple, stacked transmissive layers or plates are employed. Each transmissive plate includes different wavelength converting materials. For example, a transmissive plate including a wavelength converting material may be placed over another transmissive plate including a different wavelength converting material. In this manner, the color point of light emitted from LED based illumination device 100 may be tuned by replacing the different transmissive plates independently to achieve a desired color point. In some embodiments, the different transmissive plates may be placed in contact with each other to promote light extraction. In some other embodiments, the different transmissive plates may be separated by a distance to promote cooling of the transmissive layers. For example, airflow may be introduced through the space to cool the transmissive layers.

The mounting board 164 provides electrical connections to the attached LEDs 102. In one embodiment, the LEDs 102 are packaged LEDs, such as the Luxeon Rebel manufactured by Philips Lumileds Lighting. Other types of packaged LEDs may also be used, such as those manufactured by OSRAM (Ostar package), Luminus Devices (USA), Cree (USA), Nichia (Japan), or Tridonic (Austria). As defined herein, a packaged LED is an assembly of one or more LED die that contains electrical connections, such as wire bond connections or stud bumps, and possibly includes an optical element and thermal, mechanical, and electrical interfaces. The LEDs 102 may include a lens over the LED chips. Alternatively, LEDs without a lens may be used. LEDs without lenses may include protective layers, which may include phosphors. The phosphors can be applied as a dispersion in a binder, or applied as a separate plate. Each LED 102 includes at least one LED chip or die, which may be mounted on a submount. The LED chip typically has a size about 1 mm by 1 mm by 0.5 mm, but these dimensions may vary. In some embodiments, the LEDs 102 may include multiple chips. The multiple chips can emit light of similar or different colors, e.g., red, green, and blue. The LEDs 102 may emit polarized light or non-polarized light and LED based illumination device 100 may use any combination of polarized or non-polarized LEDs. In some embodiments, LEDs 102 emit either blue or UV light because of the efficiency of LEDs emitting in these wavelength ranges. In addition, different phosphor layers may be applied on different chips on the same submount. The submount may be ceramic or other appropriate material. The submount typically includes electrical contact pads on a bottom surface that are coupled to contacts on the mounting board 164. Alternatively, electrical bond wires may be used to electrically connect the chips to a mounting board. Along with electrical contact pads, the LEDs 102 may include thermal contact areas on the bottom surface of the submount through which heat generated by the LED chips can be extracted. The thermal contact areas are coupled to heat spreading layers on the mounting board 164. Heat spreading layers may be disposed on any of the top, bottom, or intermediate layers of mounting board 164. Heat spreading layers may be connected by vias that connect any of the top, bottom, and intermediate heat spreading layers.

In some embodiments, the mounting board 164 conducts heat generated by the LEDs 102 to the sides of the mounting board 164 and the bottom of the mounting board 164. In one example, the bottom of mounting board 164 may be thermally coupled to a heat sink 120 (shown in FIGS. 1-3) via mounting base 101. In other examples, mounting board 164 may be directly coupled to a heat sink, or a lighting fixture and/or other mechanisms to dissipate the heat, such as a fan. In some embodiments, the mounting board 164 conducts heat to a heat sink thermally coupled to the top of the mounting board 164. Mounting board 164 may be an FR4 board, e.g., that is 0.5 mm thick, with relatively thick copper layers, e.g., 30 μm to 100 μm, on the top and bottom surfaces that serve as thermal contact areas. In other examples, the mounting board 164 may be a metal core printed circuit board (PCB) or a ceramic submount with appropriate electrical connections. Other types of boards may be used, such as those made of alumina (aluminum oxide in ceramic form), or aluminum nitride (also in ceramic form).

Mounting board 164 includes electrical pads to which the electrical pads on the LEDs 102 are connected. The electrical pads are electrically connected by a metal, e.g., copper, trace to a contact, to which a wire, bridge or other external electrical source is connected. In some embodiments, the electrical pads may be vias through the mounting board 164 and the electrical connection is made on the opposite side, i.e., the bottom, of the board. Mounting board 164, as illustrated, is rectangular in dimension. However, in general, mounting board 164 may be configured in any suitable shape. LEDs 102 mounted to mounting board 164 may be arranged in different configurations on mounting board 164. In one example LEDs 102 are aligned in rows extending in the length dimension and in columns extending in the width dimension of mounting board 164. In another example, LEDs 102 are arranged in a hexagonally closely packed structure. In such an arrangement each LED is equidistant from each of its immediate neighbors. Such an arrangement is desirable to increase the uniformity and efficiency of emitted light.

Figure 6:
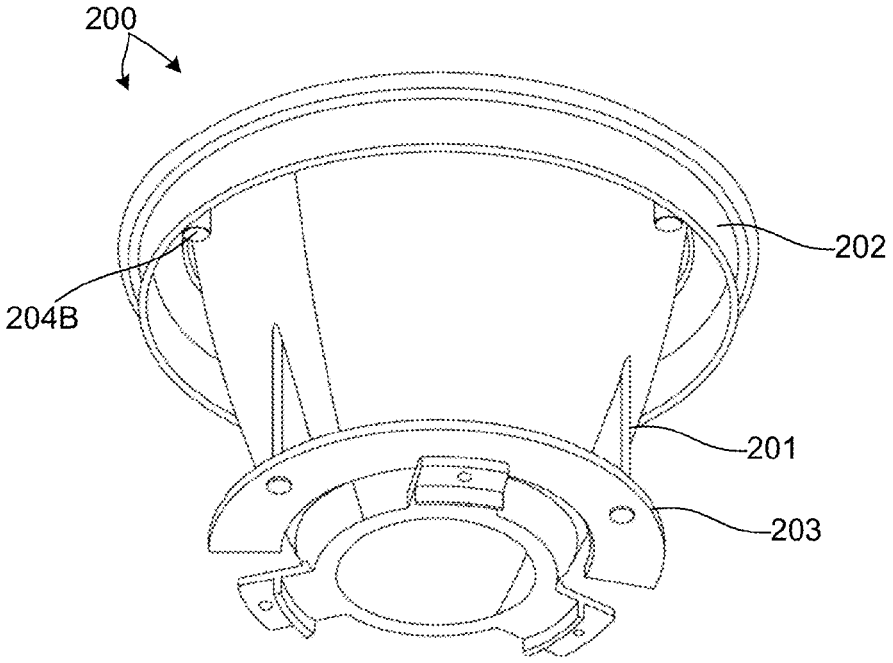
FIGS. 6 and 7 depict different perspective views of a reflector assembly that may be used with an LED based illumination device.
Figure 7:
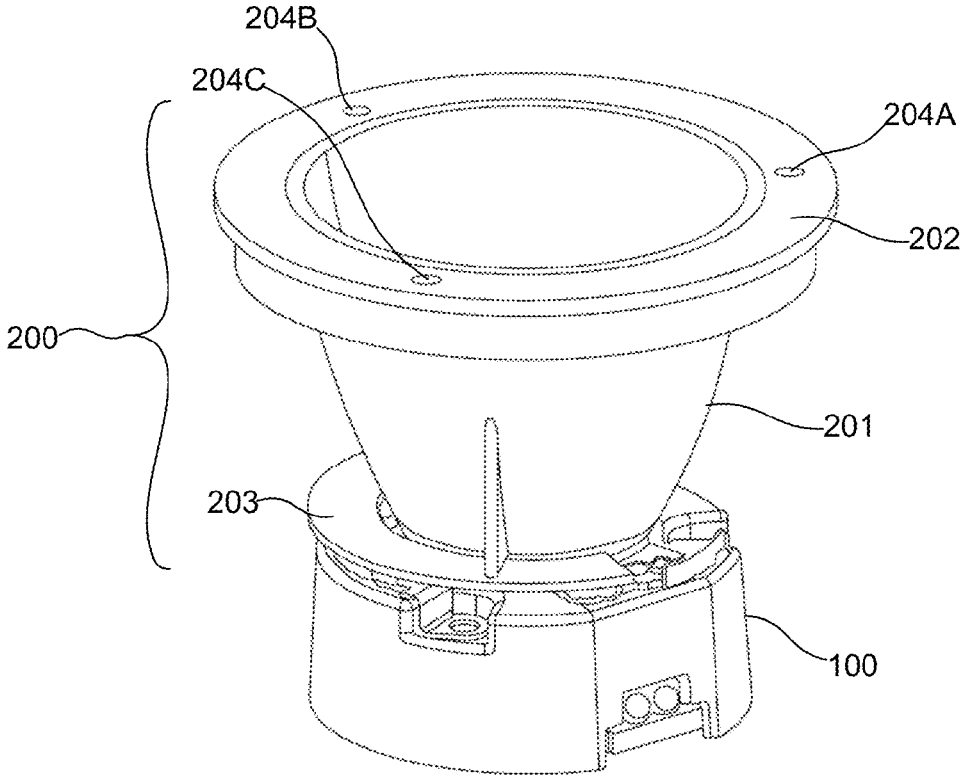

In one aspect, a detachable reflector assembly including sensing and communication capability is detachably mounted to an LED based illumination device. FIGS. 6 and 7 depict different views of a reflector assembly 200 in one embodiment. Reflector assembly 200 includes a reflector housing including a flange 202 and a reflector 201, sensors 204A-C, reflector interface module 203, and a communications interface subsystem (not shown).

As depicted in FIG. 7, reflector assembly 200 is detachably mounted to an LED based illumination device such as LED based illumination device 100 depicted in FIG. 4. In the depicted embodiment, flange 202 includes an outward facing surface. In other words, at least one surface of flange 202 faces away from the light source of LED based illumination device 100 and toward the environment illuminated by LED based illumination device 100. Sensors, such as sensors 204A-C are mounted in the reflector housing along the outward facing surface of flange 202. In this manner, sensors 204A-C are sensitive to physical signals directed toward LED based illumination device 100 and reflector assembly 200. Signals generated by sensors 204A-C are communicated to reflector interface module 203 coupled to the reflector housing for further processing or communication to another device.

Reflector 201 includes an input port configured to receive a first amount of light emitted from the LED based illumination device 100 and an output port through which light passes toward the environment. The reflecting surface(s) of reflector 201 are configured to redirect at least a portion of the light emitted from the LED based illumination device toward the output port.

Figure 8:
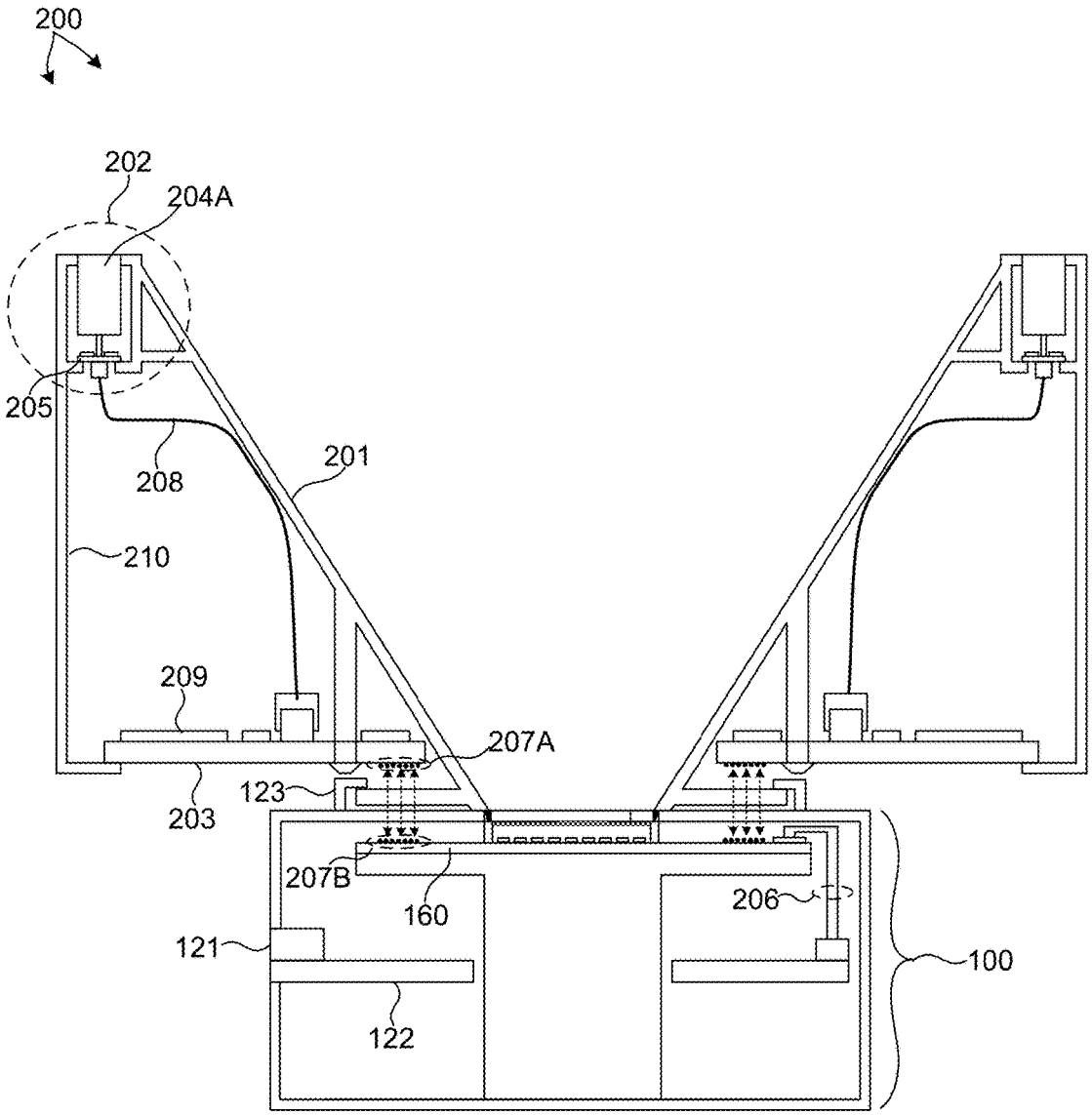
FIG. 8 depicts a cross-sectional view of one embodiment of a reflector assembly detachably coupled to LED based illumination device.

FIG. 8 depicts another embodiment of a reflector assembly 200 detachably coupled to LED based illumination device 100, e.g., by means of a clip 123, threads, a twist-lock mechanism, or other appropriate arrangement. Reflector assembly 200 includes a communications interface subsystem configured to transmit and receive communications signals to and from the reflector housing. In one embodiment, the communications interface system is configured to route communications between the sensor 204A and the LED based illumination device 100. In the depicted embodiment reflector interface module 203 includes a coiled conductor 207A and the LED mounting board of LED based light engine 160 includes a complementary coiled conductor 207B. In one embodiment, the communications interface subsystem includes conductors 207A and 207B configured to form an inductive coupling operable in accordance with a near field communications (NFC) protocol. In this manner, signals and power may be passed between reflector assembly 200 and LED based illumination device 100.

In some embodiments, signals generated by sensor 204A in combination with sensor interface electronics 205 are transmitted over conductor 208 to reflector interface module 203. The signals are communicated to the mounting board of LED based light engine 160 over the inductive coupling formed by conductors 207A-B. In some examples, the signals are further communicated to an electrical interface module 122 of LED based illumination device 100 over conductors 206. In some examples, elements of electrical interface module 122 may use these signals to generate control commands to change the illumination properties of LED based light engine 160.

In some embodiments, signals generated by sensor 204A in combination with sensor interface electronics 205 are transmitted over conductors 208 to reflector interface module 203. The signals are then communicated to electrical interface module 122 over an inductive coupling formed by conductors coiled on reflector interface module 203 and on electrical interface module 122. In some examples, elements of electrical interface module 122 may use these signals to generate control commands to change the illumination properties of LED based light engine 160.

In some embodiments, the inductive coupling is further configured to transmit electrical power between LED based illumination device and the reflector assembly 200. For example, as depicted in FIG. 8, electrical interface module 122 includes an electrical connector 121. Electrical power signals are received by electrical interface module 122 over electrical connector 121. In turn, a portion of the received electrical power may be transmitted over conductors 206 to LED based light engine 160 and through the inductive coupling formed between conductors 207A-B to reflector interface module 203. In some examples, up to five Watts of electrical power may be transmitted in this manner.

In yet another further aspect, the reflector interface module 203 includes a power bus configured to supply power to the plurality of sensors coupled to the reflector housing. In this manner, reflector interface module 203 acts as a power supply to sensors attached to the reflector assembly 200.

Many different types of sensors may be mounted to flange 202. By way of non-limiting example, one or more occupancy sensors, ambient light sensors, temperature sensors, cameras, microphones, visual indicators such as low power LEDs, ultrasonic sensors, vibration sensors, pressure sensors, gyroscopic sensor, magnetic field sensor, gas detector, smoke detector and photodetectors may be mounted to flange 202. In general, the outwardly facing surface(s) of flange 202 is suitable for any sensor collecting data from the environment illuminated by LED based illumination device 100.

In addition, one or more sensors may be located in areas of the reflector housing that are not necessarily exposed to the environment illuminated by LED based illumination device 100. For example, one or more temperature sensors, vibration sensors, gyroscopic sensor, magnetic field sensor and pressure sensors may be located on the reflector housing to monitor environmental parameters such as temperature, etc. near LED based illumination device 100, e.g., between the flange 202 and the LED based illumination device 100. For example, a temperature sensor may be mounted close to electronic components of reflector interface module 203 to monitor operating temperatures to minimize component failure.

In yet another aspect, reflector assembly 200 includes a wireless communications interface subsystem configured to transmit and receive communications signals to and from the reflector assembly 200. The wireless communications interface subsystem includes a wireless transceiver 209 operable in accordance with a wireless communications protocol, and one or more associated antennas mounted to reflector assembly 200. In some embodiments, one or more antennas are mounted to the external facing surface(s) of flange 202 to maximize communication efficiency between reflector assembly 200 and a remotely located communications device (e.g., router, mobile phone, or other computing system). Any suitable wireless communications protocol may be contemplated, (e.g., Bluetooth, 802.11, Zigbee, etc.).

Figure 9:
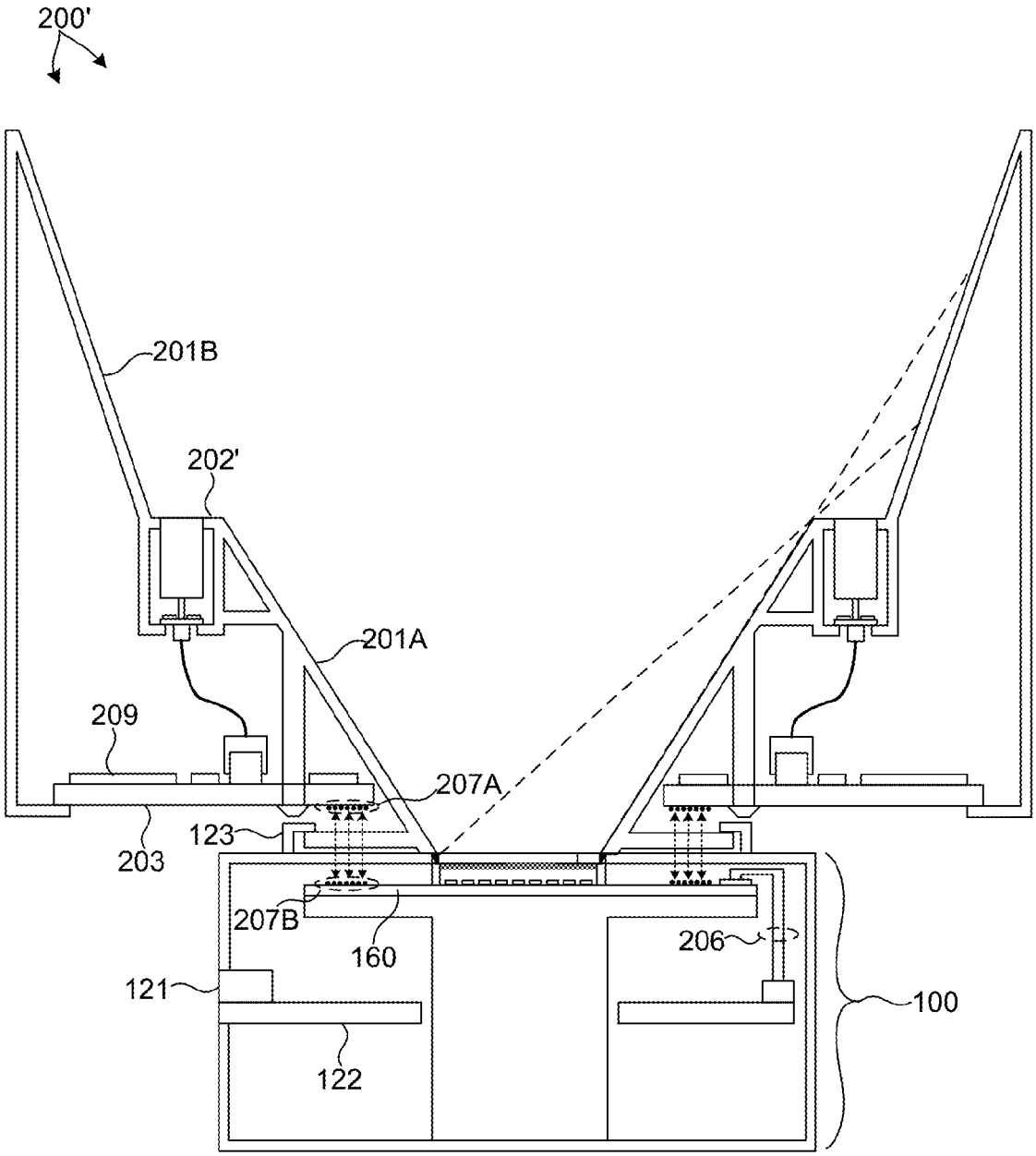
FIG. 9 depicts a cross-sectional view of another embodiment of a reflector assembly detachably coupled to LED based illumination device.

FIG. 9 depicts another embodiment of a reflector assembly 200' detachably coupled to LED based illumination device 100 in yet another embodiment. Reflector assembly 200' is similar to reflector assembly 200 discussed above, but includes two different reflective surfaces 201A and 201B separated from one another by a flange 202' between the input port and the output port of the reflector. In some embodiments, reflective surfaces 201A and 201B have different surface contours. In some embodiments, reflector surface 201A is shaped as a compound parabolic concentrator of a first angle (e.g., twenty degrees) and reflective surface 201B is shaped as a compound parabolic concentrator of a second angle (e.g., forty degrees) that is different from the first.

The flange 202' is not in the direct optical path of light emitted from LED based illumination device 100. The surface profiles of reflective surfaces 201A and 201B are selected to promote uniform light output from luminaire 150 in spite of the optical discontinuity in the reflector introduced by flange 202'.

In some embodiments, the reflector (including reflective surfaces 201A and 201B and flange 202' is manufactured as one part by a molding process. However, in some other embodiments, the shapes of reflective surfaces 201A and 201B may cause the molding of the reflector to be prohibitively difficult. In such embodiments, it is desirable to construct the reflector by combining multiple parts. For example two molded parts may be joined (e.g., by chemical bonding, friction bonding, welding, etc.).

Figure 10:
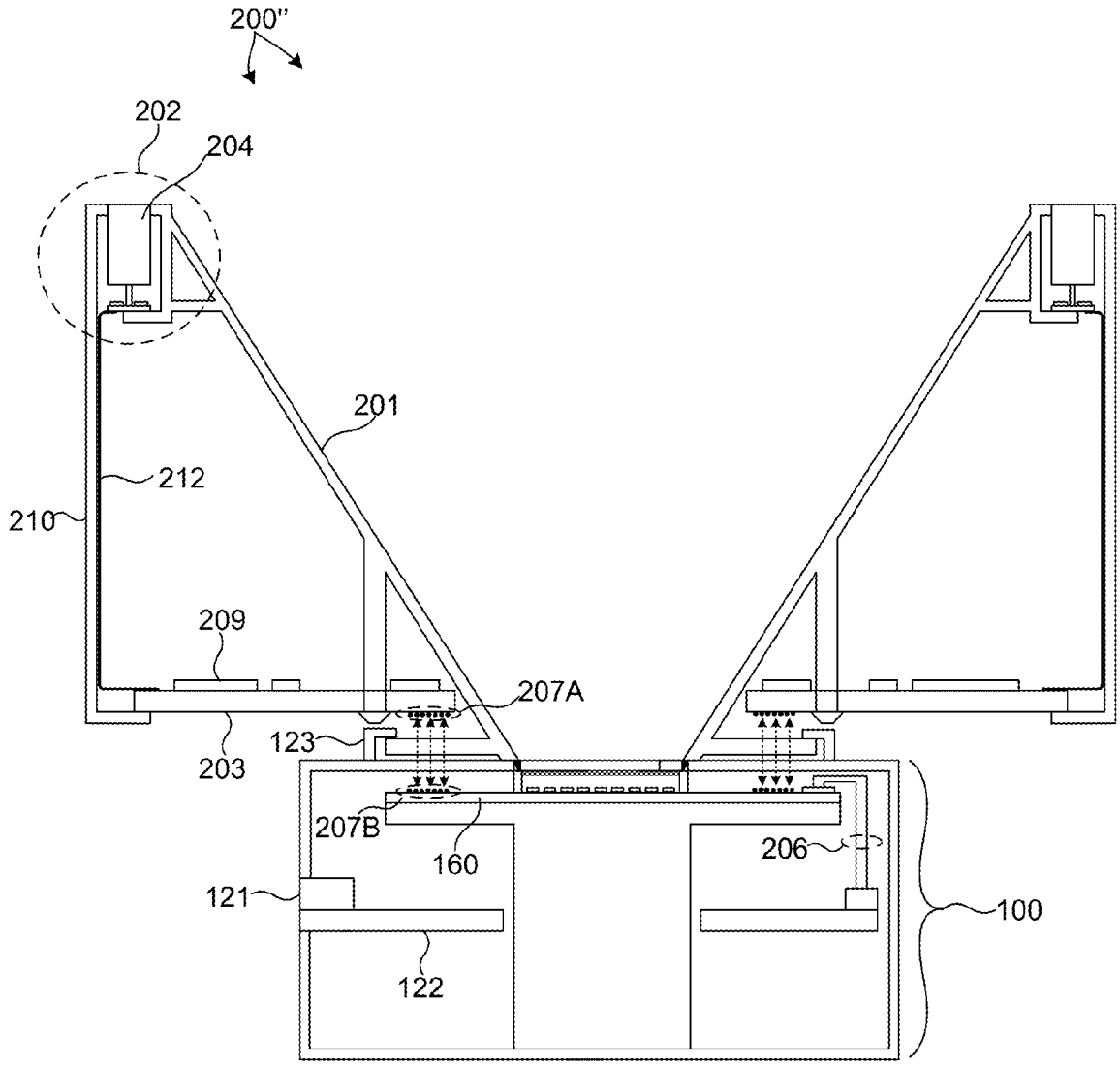
FIG. 10 depicts a cross-sectional view of another embodiment of a reflector assembly detachably coupled to LED based illumination device.

FIG. 10 depicts reflector assembly 200" detachably coupled to LED based illumination device 100 in yet another embodiment. In the depicted embodiment a flex-foil connector 212 is employed to couple sensor(s) 204 and any associated sensing electronics to reflector interface module 203. A flex-foil connector is well suited to form this interconnection as it can be shaped as a flat sheet and then bent to fit the curved wall of the reflector housing 210.

Figure 11:
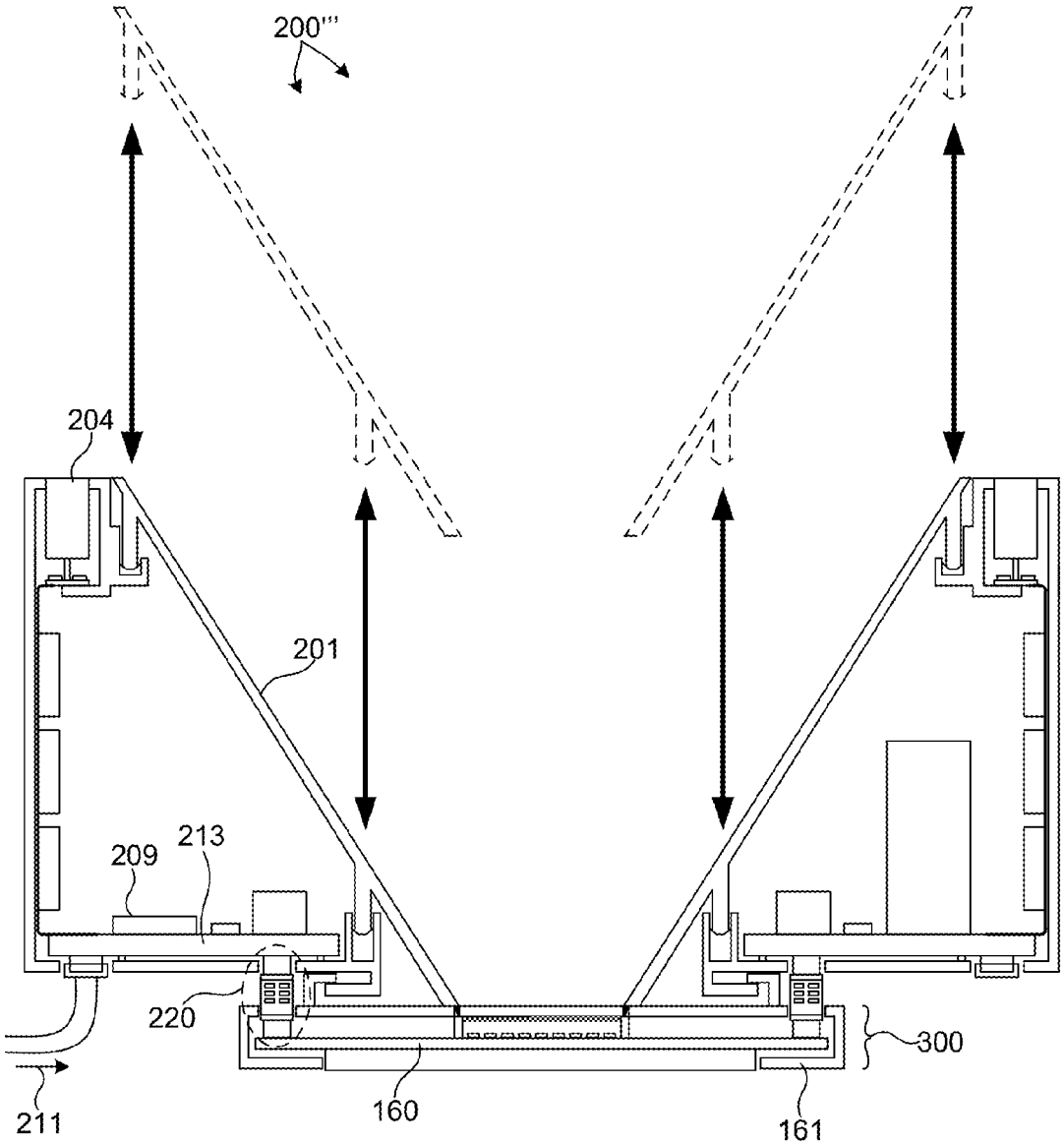
FIG. 11 depicts a cross-sectional view of another embodiment of a reflector assembly detachably coupled to LED based illumination device.

FIG. 11 depicts reflector assembly 200'" detachably coupled to an LED based illumination device 300 in yet another embodiment. In the depicted embodiment, electronics interface board 213 includes a direct current to direct current (DC/DC) power converter. The DC/DC power converter is configured to supply power to one or more LEDs of the LED based illumination device over a wired connection 220 between the reflector housing 210 and the LED based illumination device 300. As depicted, electrical power signals 211 are supplied to electronics interface board 213. The electrical power signals are processed by the DC/DC power converter to generate current signals supplied to the LEDs of LED based illumination device. Connector 220 is configured to electrically couple reflector assembly 200'" to the LED based illumination device as the relector assembly 200'" is mechanically coupled to the LED based illumination device. In the depicted embodiment, LED based illumination device 300 is a minimal cost lighting device including an LED based light engine 160 and a housing 161. An example of such a lighting device is the Xicato Thin Module (XTM) manufactured by Xicato, Inc., San Jose, Calif. (USA).

In yet another aspect, the reflector of reflector assembly 200'" is detachably coupled to reflector housing 210. As depicted in FIG. 10, reflector 201 is included engaging features that allow for selective attachment and detachment of reflector 201 for the reflector housing 210. In this manner, different reflector shapes can be interchangeably located within reflector housing 210 to satisfy particular optical requirements.

In some embodiments, reflector interface module 203 includes a Power Line Communication (PLC) module operable to receive a electrical power signal and decode a communication signal from the electrical power signal (e.g., signals 211).

In a further aspect, reflector interface module 203 includes a memory that can be employed to store identification data, operational data, etc. For example, an identification number, a network security key, commissioning information, etc. may be stored on the memory.

In another further aspect, reflector interface module 203 includes a processor and processor readable instructions stored on the memory that cause the processor to receive a control signal on a first input node of the reflector interface module 203, determine a desired luminous output of the LED based illumination device based on the control signal, and transmit a command signal to the direct current to direct current (DC/DC) power converter electrically coupled to the LED based illumination device to change the luminous output of the LED based illumination device. In this manner, a processor on board the reflector interface module 203 provides control over the light emitted from the luminaire 150.

In some embodiments, the control signal the control signal adheres to any of a Digital Addressable Lighting Interface (DALI) standard, a DMX standard, and a 0-10 Volt standard.

In some embodiments, the command signal is based on a sensor signal received from a sensor 204 coupled to the reflector housing.

In another aspect, a top facing heat sink is detachably coupled to the LED based illumination device, wherein the reflector interface module is disposed between the top facing heat sink and the reflector.

Figure 12:
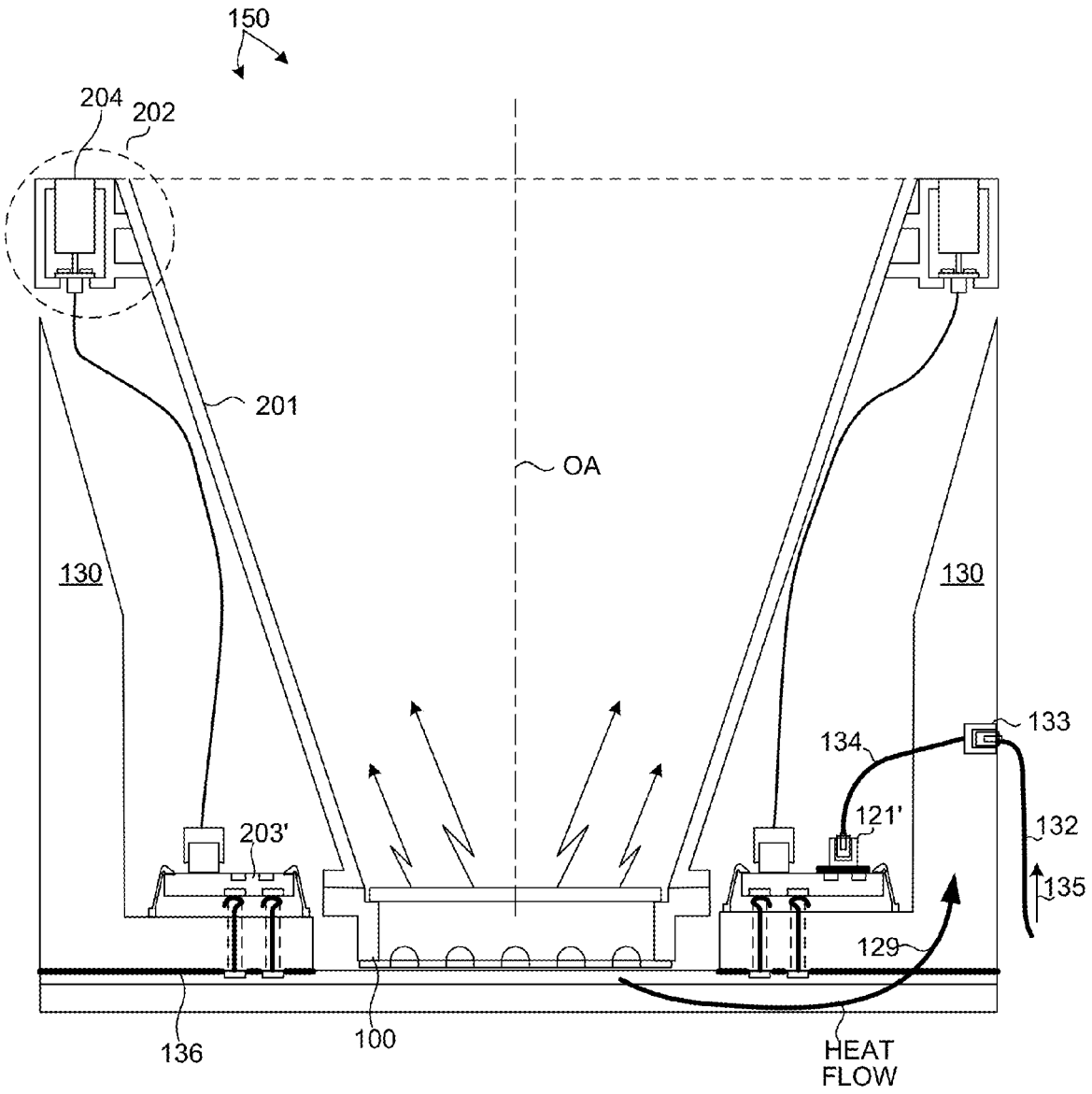
FIG. 12 depicts a cross-sectional view of a luminaire including a top facing heat sink coupled to an LED based illumination device and a reflector.

FIG. 12 depicts a cross-sectional view of a luminaire 150 including reflector 201 and a top facing heat sink 130 coupled to an LED based illumination device 100 over thermal interface area 136. A portion of the heat generated by LED based illumination device 100 is transmitted from LED based illumination device 100 to top facing heat sink 130 over thermal interface area 136. Reflector interface module 203 is located between the heat sink 130 and the reflector 201. Top facing heat sink 130 is operable to dissipate a significant percentage of heat generated by LED based illumination device 100 to the environment, as illustrated by arrow 129, and is detachably coupled to illumination device 100, e.g., by means of threads, a clamp, a twist-lock mechanism, or other appropriate arrangement. In some embodiments, more than twenty five percent of heat generated by LED based illumination device 100 is dissipated to the environment through removable, top facing heat sink 130. In some other embodiments, more than fifty percent of heat generated by LED based illumination device 100 is dissipated to the environment through removable, top facing heat sink 130. In some other embodiments, more than seventy five percent of heat generated by LED based illumination device 100 is dissipated to the environment through removable, top facing heat sink 130.

Reflector 201 may also be made from thermally conductive material and may be thermally coupled to any of illumination device 100 and top facing heat sink 130. In these embodiments, heat flows by conduction into thermally conductive reflector 201 and is dissipated into the environment. Heat also flows via thermal convection over the reflector 201. Optical elements, such as a diffuser or reflector may be detachably coupled to illumination device 100, e.g., by means of threads, a clamp, a twist-lock mechanism, or other appropriate arrangement.

The top facing heat sink 130 and reflector 201 are detachably coupled to illumination device 100. For example, any of top facing heat sink 130 and reflector 201 may be coupled to illumination device 100 by a twist-lock mechanism. In this manner any of top facing heat sink 130 and reflector 201 is aligned with illumination device 100 and is coupled to illumination device 100 by rotating any of top facing heat sink 130 and reflector 201 about an optical axis (OA) of luminaire 150. In the engaged position, an interface pressure is generated between mating thermal interface surfaces of any of top facing heat sink 130 and reflector 201 and illumination device 100. In this manner, heat generated by LEDs of the LED based illumination device is dissipated into any of top facing heat sink 130 and reflector 201.

In some embodiments, luminaire 150 includes an reflector interface module 203' within an envelope formed by top facing heat sink 130. The reflector interface module 203' communicates electrical signals to and from reflector assembly 200. In the embodiment depicted in FIG. 12, electrical conductors 132 are coupled to luminaire 150 at electrical connector 133. By way of example, electrical connector 133 may be a registered jack (RJ) connector commonly used in network communications applications. In other examples, electrical conductors 132 may be coupled to luminaire 150 by screws or clamps. In other examples, electrical conductors 132 may be coupled to luminaire 150 by a removable slip-fit electrical connector. Connector 133 is coupled to conductors 134. Conductors 134 are detachably coupled to electrical connector 121' mounted to reflector interface module 203'. Similarly, electrical connector 121' may be a RJ connector or any suitable removable electrical connector. Electrical signals 135 are communicated over electrical conductors 132 through electrical connector 133, over conductors 134, through electrical connector 121' to reflector interface module 203'. Reflector interface module 203' routes electrical signals 135 from electrical connector 121' to appropriate electrical contact pads on reflector interface module 203'. Electrical signals 135 may include power signals and data signals. In the illustrated example, spring pins couple contact pads of reflector interface module 203' to contact pads of an LED mounting board. In this manner, electrical signals are communicated from reflector interface module 203' to the LED mounting board. The LED mounting board includes conductors to appropriately couple LEDs to the contact pads. In this manner, electrical signals are communicated from the mounting board to appropriate LEDs to generate light.

Although certain specific embodiments are described above for instructional purposes, the teachings of this patent document have general applicability and are not limited to the specific embodiments described above. Accordingly, various modifications, adaptations, and combinations of various features of the described embodiments can be practiced without departing from the scope of the invention as set forth in the claims.

What is claimed is:

1. An apparatus comprising:

a reflector housing configured to be detachably coupled to an LED based illumination device configured to illuminate an environment, the reflector housing comprising:

a flange having a surface facing the environment illuminated by the LED based illumination device; and a reflector having an input port configured to receive a first amount of light emitted from the LED based illumination device and an output port through which light passes toward the environment, wherein the reflector is configured to redirect at least a portion of the first amount of light emitted from the LED based illumination device toward the output port;

a sensor coupled to the flange of the reflector housing such that at least a portion of the sensor faces the environment illuminated by the LED based illumination device;

a reflector interface module coupled to the reflector housing, the reflector interface module configured to receive at least one signal from the sensor; and a first communications interface subsystem configured to transmit and receive communications signals to and from the reflector housing.

2. The apparatus of claim 1, wherein the reflector interface module includes a power bus configured to supply power to a plurality of sensors coupled to the reflector housing.

3. The apparatus of claim 1, wherein the sensor is communicatively coupled to the first communications interface subsystem, and wherein the the first communications interface subsystem is configured to route communications between the sensor and the LED based illumination device.

4. The apparatus of claim 3, wherein the first communications interface subsystem includes an inductive coupling operable in accordance with a near field communications (NFC) protocol.

5. The apparatus of claim 4, further comprising:

a second communications interface including a wireless transceiver operable in accordance with a wireless communications protocol, the second communications interface configured to route communications between the reflector housing and a remotely located computing system.

6. The apparatus of claim 5, further comprising:

an antenna coupled to the flange of the reflector housing, the antenna configured to receive communication signals onto the wireless transceiver.

7. The apparatus of claim 1, further comprising:

a direct current to direct current (DC/DC) power converter coupled to the reflector housing, wherein the DC/DC power converter is configured to supply power to one or more LEDs of the LED based illumination device over a wired connection between the reflector housing and the LED based illumination device.

8. The apparatus of claim 1, wherein the reflector is removable from the reflector housing.

9. The apparatus of claim 1, wherein the flange is disposed around a perimeter of the output port of the reflector.

10. The apparatus of claim 1, wherein the reflector includes a first reflective surface between the input port and the output port having a first surface profile; and a second reflective surface between the input port and the output port having a second surface profile, the second reflective surface separated from the first reflective surface by the flange.

11. The apparatus of claim 10, wherein the second reflective surface is positioned between the flange and the output port, and wherein the first reflective surface is positioned between the input port and the flange.

12. The apparatus of claim 11, wherein the first reflective surface includes a reflective surface of a first contour and the second reflective surface includes a reflective surface of a second contour.

13. The apparatus of claim 12, wherein the first contour is a compound parabolic concentrator of a first angle and the second contour is a compound parabolic concentrator of a second angle.

14. The apparatus of claim 1, wherein the sensor is any of an occupancy sensor, an ambient light sensor, a temperature sensor, a camera, a microphone, a visual indicator, an ultrasonic sensor, a vibration sensor, a pressure sensor, gyroscopic sensor, magnetic field sensor, gas detector, smoke detector, and a photodetector.

15. The apparatus of claim 4, wherein the inductive coupling is further configured to transmit an amount of electrical power between the LED based illumination device and the reflector housing.

16. The apparatus of claim 15 wherein the amount of electrical power is less than five Watts.

17. The apparatus of claim 1, further comprising:

a second sensor coupled to the reflector housing between the flange and the LED based illumination device.

18. The apparatus of claim 17, wherein the second sensor is any of a temperature sensor, a vibration sensor, gyroscopic sensor, magnetic field sensor and a pressure sensor.

19. The apparatus of claim 1, further comprising:

a top facing heat sink configured to be detachably coupled to the LED based illumination device, wherein the reflector interface module is disposed between the top facing heat sink and the reflector.

20. The apparatus of claim 1, further comprising:

a Power Line Communication (PLC) module operable to receive an electrical power signal and decode a communication signal from the electrical power signal.

21. The apparatus of claim 1, further comprising:

a memory operable to store an identification number associated with the apparatus.

22. The apparatus of claim 21, wherein the memory is configured to store a network security key.

23. The apparatus of claim 21, wherein the memory is configured to store an amount of commissioning information associated with the apparatus.

24. The apparatus of claim 1, wherein the reflector interface module includes:

a processor; and a non-transitory, computer readable medium storing instructions that when executed by the processor cause the reflector interface module to:

receive a control signal on a first input node;

determine a desired luminous output of the LED based illumination device based on the control signal; and transmit a command signal to a direct current to direct current (DC/DC) power converter electrically coupled to the LED based illumination device.

25. The apparatus of claim 24, wherein the control signal adheres to any of a Digital Addressable Lighting Interface (DALI) standard, a DMX standard, and a 0-10 Volt standard.

26. The apparatus of claim 24, wherein the control signal is based on a sensor signal received from the sensor coupled to the reflector housing.

* * * * *